US010900677B2

(12) United States Patent
Chen

(10) Patent No.: US 10,900,677 B2
(45) Date of Patent: Jan. 26, 2021

(54) HUMIDIFYING DEVICE, AIR CLEANER AND HOUSEHOLD APPLIANCE

(71) Applicant: 3M INNOVATIVE PROPERTIES COMPANY, St. Paul, MN (US)

(72) Inventor: Leitao Chen, Jiangsu (CN)

(73) Assignee: 3M Innovative Properties Company, St. Paul, MN (US)

( * ) Notice: Subject to any disclaimer, the term of this patent is extended or adjusted under 35 U.S.C. 154(b) by 3 days.

(21) Appl. No.: 16/322,856

(22) PCT Filed: Aug. 2, 2017

(86) PCT No.: PCT/US2017/045051

§ 371 (c)(1),
(2) Date: Feb. 1, 2019

(87) PCT Pub. No.: WO2018/026891

PCT Pub. Date: Feb. 8, 2018

(65) Prior Publication Data

US 2020/0191417 A1 Jun. 18, 2020

(30) Foreign Application Priority Data

Aug. 2, 2016 (CN) ..... 2016 1 0625626

(51) Int. Cl.
*F24F 3/16* (2006.01)
*F24F 6/00* (2006.01)
(Continued)

(52) U.S. Cl.
CPC ..... *F24F 3/1603* (2013.01); *F24F 6/00* (2013.01); *F24F 6/06* (2013.01); *F24F 7/007* (2013.01);
(Continued)

(58) Field of Classification Search
CPC .... F24F 6/06; F24F 3/1603; F24F 6/00; F24F 7/007; F24F 13/28; F24F 2006/008;
(Continued)

(56) References Cited

U.S. PATENT DOCUMENTS 8,034,169 B2 10/2011 Yamashita et al.
9,518,750 B2 12/2016 Shimizu
(Continued)

FOREIGN PATENT DOCUMENTS

CN 203249333 10/2013
CN 104132416 A 11/2014
(Continued)

OTHER PUBLICATIONS

EPO translation of JP2003302077 (Year: 2003).*
International Search report for PCT International Application No. PCT/US2017.045051 dated Nov. 13, 2017, 5 pages.

*Primary Examiner* — Stephen Hobson
(74) *Attorney, Agent, or Firm* — Kevin Weber

(57) ABSTRACT

The present disclosure provides a humidifying device, including: a container, configured to accommodate a liquid; a first moisture absorptive member, partially or completely dipped in the liquid in the container; a second moisture absorptive member with air permeability, in contact with or isolated from the first moisture absorptive member; and a driving member, configured to control movement of the second moisture absorptive member, so as to allow the second moisture absorptive member to be in contact with or isolated from the first moisture absorptive member. The humidifying device according to the present disclosure can be applied in household appliances such as air cleaners and air conditioners. The operation and shut down of the humidification function is controlled, so as to avoid formation of superfluous air resistance when the humidification function is shut down. The present disclosure further provides an air
(Continued)

cleaner and a household appliance, including the humidifying device provided according to the present disclosure. The air cleaner and the household appliance are not only simple in structure, effective in cost, and convenient in installation, but are also quiet when in operation.

12 Claims, 6 Drawing Sheets

(51) Int. Cl.
*F24F 6/06* (2006.01)
*F24F 7/007* (2006.01)
*F24F 13/28* (2006.01)

(52) U.S. Cl.
CPC ..... *F24F 13/28* (2013.01); *F24F 2006/008* (2013.01)

(58) Field of Classification Search
CPC ..... F24F 2006/065; F24F 6/04; F24F 6/02; F24F 6/043; F24F 13/00
See application file for complete search history.

(56) References Cited

U.S. PATENT DOCUMENTS

| | | | | |
|---|---|---|---|---|
| 10,145,572 | B2 * | 12/2018 | Dinnage | F24F 6/06 |
| 2003/0193098 | A1 * | 10/2003 | LeMahieu | F24F 6/043 261/107 |
| 2010/0201007 | A1 | 9/2010 | Tsuda et al. | |
| 2010/0258644 | A1 * | 10/2010 | Kagawa | C02F 1/4608 236/44 A |
| 2011/0048237 | A1 | 3/2011 | Ahn et al. | |
| 2014/0145355 | A1 | 5/2014 | Shimizu | |
| 2015/0204626 | A1 * | 7/2015 | Martell | F28F 5/00 165/200 |
| 2017/0130977 | A1 | 5/2017 | Wang et al. | |
| 2017/0130986 | A1 | 5/2017 | Wang et al. | |
| 2017/0153029 | A1 | 6/2017 | Wang et al. | |

FOREIGN PATENT DOCUMENTS

| | | | | | |
|---|---|---|---|---|---|
| CN | 204026900 | | | 12/2014 | |
| CN | 104428598 | | | 2/2016 | |
| CN | 105371408 | A | | 3/2016 | |
| CN | 104566743 | | | 3/2018 | |
| DE | 3243080 | A1 | * | 5/1984 | F24F 6/06 |
| DE | 9304910 | U1 | * | 6/1993 | F24F 3/166 |
| DE | 4401294 | A1 | * | 7/1995 | F24F 6/06 |
| EP | 2333441 | | | 6/2011 | |
| JP | 2516035 | Y2 | * | 11/1996 | |
| JP | 2578657 | B2 | * | 2/1997 | |
| JP | 2002206809 | A | * | 7/2002 | |
| JP | 2003302077 | | * | 10/2003 | |
| JP | 2003302077 | A | * | 10/2003 | |
| JP | 2006071146 | A | * | 3/2006 | |
| JP | 3776423 | B2 | * | 5/2006 | |
| JP | 3776426 | B2 | * | 5/2006 | |
| JP | 2006145181 | A | * | 6/2006 | |
| JP | 2008-064433 | | | 3/2008 | |
| JP | 2009156479 | A | * | 7/2009 | |
| JP | 2010065853 | A | * | 3/2010 | |
| JP | 4595366 | B2 | * | 12/2010 | |
| JP | 2011-179800 | | | 9/2011 | |
| JP | 4775414 | B2 | * | 9/2011 | |
| JP | 2012233611 | A | * | 11/2012 | |
| JP | 5626171 | B2 | * | 11/2014 | |
| JP | 5674326 | B2 | * | 2/2015 | |
| JP | 2017009181 | A | * | 1/2017 | |
| JP | 6400531 | B2 | * | 10/2018 | |
| KR | 10-2012-0101788 | | | 9/2012 | |
| WO | WO-2009078142 | A1 | * | 6/2009 | |
| WO | WO 2009/109977 | | | 9/2009 | |
| WO | WO-2010024152 | A1 | * | 3/2010 | F24F 6/06 |
| WO | WO-2016103724 | A1 | * | 6/2016 | B01F 3/0407 |

* cited by examiner

HUMIDIFYING DEVICE, AIR CLEANER AND HOUSEHOLD APPLIANCE

CROSS REFERENCE TO RELATED APPLICATIONS

This application is a national stage filing under 35 U.S.C. 371 of PCT/US2017/045051, filed Aug. 2, 2017, which claims the benefit of Chinese Application No. 201610625626.0, filed Aug. 2, 2016, the disclosure of which is incorporated by reference in its/their entirety herein.

TECHNICAL FIELD

The present disclosure relates to a household appliance, and particularly to a humidifying device and an air cleaner including the humidifying device.

BACKGROUND

In the field of household appliances, a humidification function has been increasingly applied to appliances. The most typical example is an air cleaner that combines the purification function and the humidification function, so as to realize both purification and humidification of air at the same time, thereby better satisfying users' requirements.

In different application scenarios, users also have somewhat different requirements for the humidification function. Take air cleaners as an example. In a dry environment, the humidification function is activated to clean the air and at the same time humidify the air; and in a humid environment, the humidification function is shut down to only clean air. Therefore, there is a need for a way to control operation and shut down of the humidification function, so as to allow the air cleaner to not only run in the dual mode of purification and humidification, but also run only in the mode of purification.

Principles to control operation of the humidification function employed in the prior art mainly include the following three principles:

Principle 1: controlling water supply to the humidification module. Water is supplied or not supplied to a humidification module through hydraulic elements such as valves and pumps in combination with mechanical or electronic control, thereby controlling operation of the humidification function. A Chinese utility model (CN203249333U) features an air processing device. A water supply switch is arranged between a first part and a second part of the water tank. When the water supply switch is located in the first position, water supply from the first part to the second part of the water tank is essentially cut off. When the water supply switch is located in the second position, water supply from the first part to the second part of the water tank is switched on.

Principle 2: controlling the air flow. Whether the humidification function is in operation is controlled by passing air or not passing air through the humidification module. A Chinese invention patent application (CN101500618A) features an air cleaner. An air flow channel is branched into two portions, and a hygroscopic medium is placed in one portion thereof. Whether the air flow will pass through the hygroscopic medium is controlled by controlling changes in the air flow channel, thereby controlling whether the humidification module is run.

Principle 3: controlling the hygroscopic medium. Whether the humidification function is in operation is controlled by the presence or absence or the relative position of the hygroscopic medium in the humidification module.

In quite a few prior art constructions, a humidification wheel structure is employed in combination with Principles 1 and 3, and the motion state of the humidification wheel is controlled through mechanical or electronic driving. No matter if the humidification function is in operational service, the humidification medium is located above the cross section of the gas flow channel as in, for example, technical solutions cited in Japanese patent application (JP2008-64433A), U.S. Patent application (US2010/0201007A1) and Chinese invention patent application (CN104428598 A).

How to control operation and shut down of the humidification function, and avoid formation of unnecessary air resistance when the humidification function is shut down are technical problems the present inventors strive to solve in the present disclosure.

SUMMARY

As different from the principles and methods employed in the prior art, the present disclosure provides a humidifying device that can control operation and shut down of the humidification function, including: a container configured to accommodate a liquid; a first moisture absorptive member, partially or completely dipped in the liquid in the container; a second moisture absorptive member with air permeability, in contact with or isolated from the first moisture absorptive member, where when the humidification function is in operation, the second moisture absorptive member is in contact with the first moisture absorptive member, and when the humidification function is shut down, the second moisture absorptive member is isolated from the first moisture absorptive member; and a driving member, configured to control movement of the second moisture absorptive member, to allow the second moisture absorptive member to be in contact with or isolated from the first moisture absorptive member.

The first moisture absorptive member is allowed to stand still in the container and draw liquid from the container. When the humidification function is in operation, the driving member controls movement of the second moisture absorptive member, to allow it to contact the first moisture absorptive member and draw the liquid through the first moisture absorptive member, and air is passed mainly through the second moisture absorptive member, to realize operation of the humidification function. When the humidification function is shut down, the driving member controls movement of the second moisture absorptive member, to allow it to be isolated from the first moisture absorptive member, at which time, the second moisture absorptive member stops drawing liquid from the first moisture absorptive member, and the second moisture absorptive member moves away from the gas flow channel, so as to realize shut down of the humidification function.

According to certain particular embodiments of the present disclosure, when the second moisture absorptive member is brought into contact with the first moisture absorptive member, the second moisture absorptive member has a maximum blocking area, and when the second moisture absorptive member is isolated from the first moisture absorptive member, the second moisture absorptive member has a minimal blocking area.

According to certain particular embodiments of the present disclosure, the driving member includes a driving motor and a driving connecting rod that are connected to each other, and the driving connecting rod connects to and drives movement of the second moisture absorptive member.

According to certain particular embodiments of the present disclosure, the first moisture absorptive member is perpendicular to a still water surface of the liquid, and the driving connecting rod drives rotation of the second moisture absorptive member around a fixed end of the driving connecting rod, to allow the contact surface when the second moisture absorptive member is brought into contact with the first moisture absorptive member, to be parallel to the still water surface.

According to certain particular embodiments of the present disclosure, the first moisture absorptive member and the second moisture absorptive member are presented as cuboids or cylinders.

According to certain particular embodiments of the present disclosure, the first moisture absorptive member and the second moisture absorptive member include moisture absorptive bodies with a hygroscopic property, and the moisture absorptive bodies are at least one selected from a group consisting of wicks and dampening papers.

According to certain particular embodiments of the present disclosure, the first moisture absorptive member and the second moisture absorptive member further include supports covering surfaces of the moisture absorptive bodies.

According to certain particular embodiments of the present disclosure, the container includes: a water injection tank; a closed chamber, including through-holes on the top thereof, where the first moisture absorptive member is placed within the closed chamber and communicatively connected to the outside via the through-holes; and a drainage hole, communicatively connected to the water injection tank and the closed chamber.

According to certain particular embodiments of the present disclosure, the liquid is water.

The humidifying devices of the present disclosure have at least one of the following advantages and beneficial effects:

Firstly, the humidifying device according to the present disclosure can be applied in household appliances such as air cleaners and air conditioners, to control operation and shut down of the humidification function.

Secondly, in some technical solutions of the prior art, no matter if the humidification function is in operation, air is always passed through a humidification medium, which will form unnecessary wind resistance and influence regular service of household appliances such as air cleaners and air conditioners.

However, in the humidifying device of the present disclosure, when the humidification function is shut down, air is passed directly through the gas flow channel, to avoid formation of unnecessary air resistance.

The present disclosure further provides an air cleaner, including: a housing, having an air-in panel and an air-out panel; an air strainer, provided downstream the air-in panel; a humidifying device, provided downstream the air-in panel; a fan, provided downstream the air-in panel; and a air-out panel, provided downstream the air strainer, the humidifying device and the fan.

The present disclosure further provides a household appliance, including the humidifying device provided according to the present disclosure.

The air cleaner and the household appliance of the present disclosure are not only simple in structure, effective in cost, and convenient in installation, but are also quiet when in operation.

"The blocking area of the second moisture absorptive member" as used in this specification and claims refers to the area in the direction perpendicular to the air flow of air passing through the second moisture absorptive member.

The "upstream" and "downstream" as used in this specification and claims are defined by the sequence that air passes the elements, and the element that the air passes through firstly is located upstream from the element that the air passes through later, and the element that the air passes through later is located downstream from the element that the air passes through firstly.

BRIEF DESCRIPTION OF DRAWINGS

In order to make the above and other objects, features and advantages of the present disclosure more obvious and understandable, the present disclosure will be further explained below in combination with accompanying drawings and particular embodiments. It is to be understood by those of skill in the art that, the accompanying drawings are intended to schematically explain preferred embodiments of the present disclosure, where various members in the figures are not drawn to scale.

| List of Reference Numbers | | |
|---|---|---|
| 10 Humidifying device | 11 First moisture absorptive member | 12 Second moisture absorptive member |
| 120 Moisture absorptive body | 121 Support | 13 Container |
| 130 Liquid | 131 Drainage hole | 132 Closed chamber |
| 133 Water injection tank | 14 Driving member | 141 Driving motor |
| 142 Driving connecting rod | | |
| 1 Air cleaner | 20 Air strainer | 30 Fan |
| 40 Housing | 41 Air-in panel | 42 Air-out panel |

DESCRIPTION OF EMBODIMENTS

Some particular embodiments according to the present disclosure will be explained below in more details in combination with accompanying drawings. It is to be understood that those of skill in the art can envisage other various embodiments according to teachings in this specification and can make modifications thereto, without departing from the scope or spirit of the present disclosure. Therefore, the following particular embodiments are illustrative but not restrictive.

All figures for denoting characteristic dimensions, quantities and physical properties used in this specification and claims are to be understood as modified by a term "about", unless indicated otherwise. Therefore, unless otherwise stated, numerical parameters listed in this specification and the claims are all approximate values, and those of ordinary skill in the art are capable of seeking to obtain desired properties by appropriately changing these approximate values, according to teachings of the present disclosure. A numerical range represented by end points includes all figures within the range. For example, 1 to 5 includes 1, 1.1, 1.3, 1.5, 2, 2.75, 3, 3.80, 4, 5, and the like.

Figure 1:
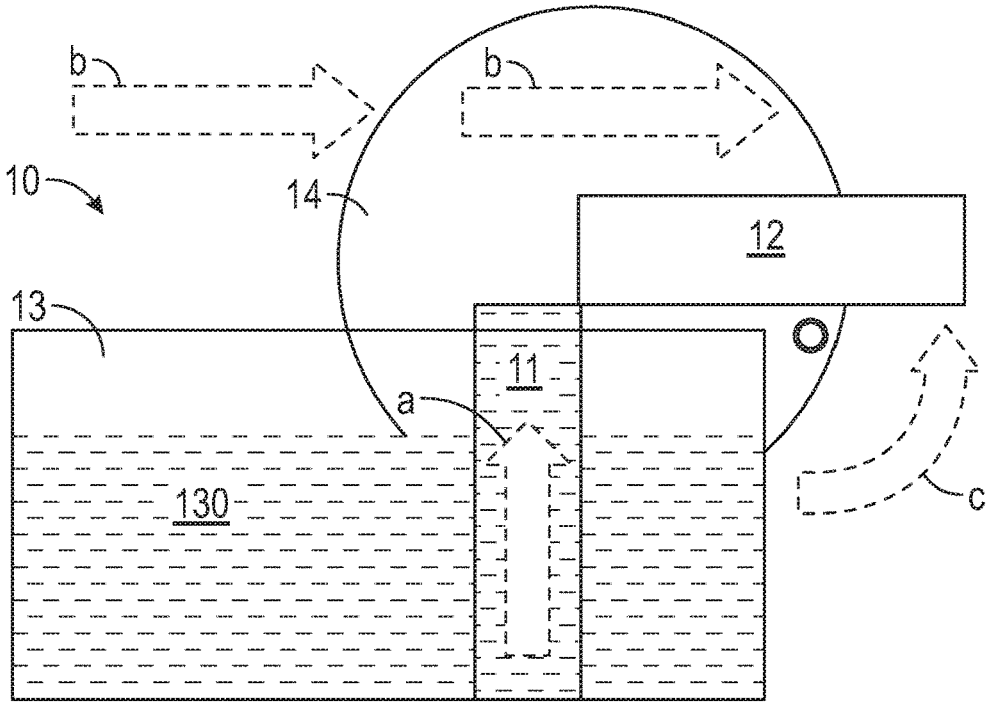
FIG. 1 is a structural representation of a humidifying device according to certain particular embodiments of the present disclosure with the humidification function being shut down.

FIG. 1 exemplarily shows a structure of a humidifying device 10 of the present disclosure with the humidification function being shut down, where a container 13 contains a liquid 130, a first moisture absorptive member 11 is placed in the container 13 and draws the liquid 130 in a direction as shown by an arrow "a". However, at this time, a second moisture absorptive member 12 is isolated from the first moisture absorptive member 11, and the liquid 130 cannot be delivered to the second moisture absorptive member 12, and at this time, the relative position of the second moisture absorptive member 12 is away from the gas flow channel, and air passes through the humidifying device 10 in a direction as shown by an arrow "b". A driving member 14 controls movement of the second moisture absorptive member 12. When receiving a sign of "operate" of the humidification function sent from outside, the driving member 14 controls the second moisture absorptive member 12 to allow it to rotate along the direction as shown by the arrow "c" and finally contact the first moisture absorptive member 11.

Figure 2:
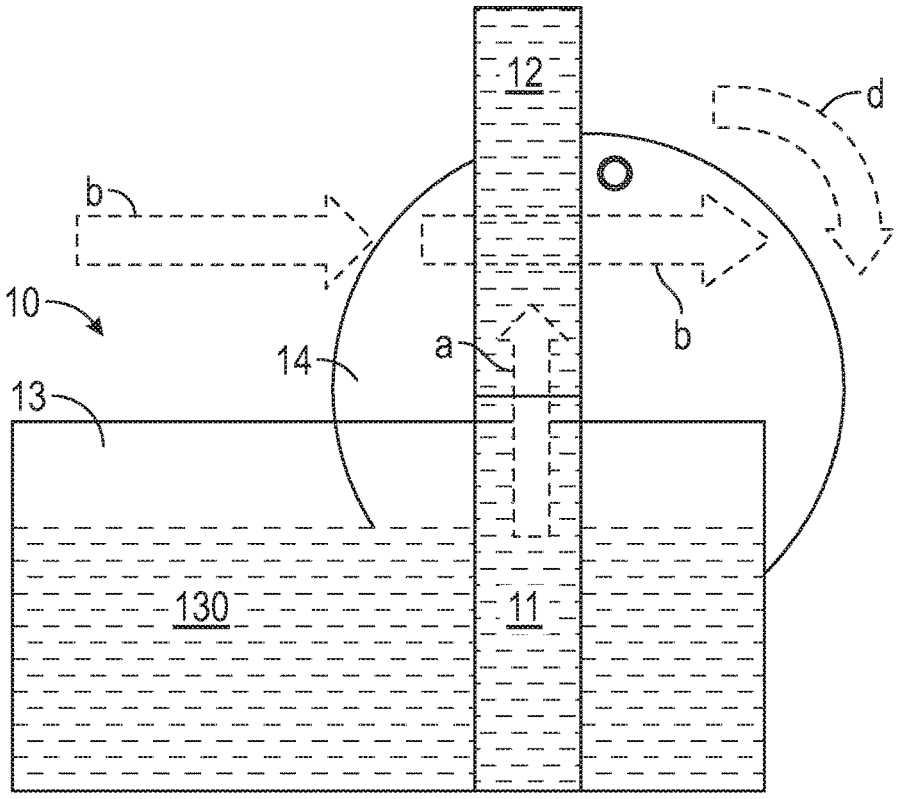
FIG. 2 is a structural representation of a humidifying device according to certain particular embodiments of the present disclosure with the humidification function being in operation.

FIG. 2 schematically shows a structure of a humidifying device 10 of the present disclosure with the humidification function being in operation, where at this time, a second moisture absorptive member 12 contacts the first moisture absorptive member 11, for example in the direction as shown by an arrow "a", and the liquid 130 is delivered to the second moisture absorptive member 12 through the first moisture absorptive member 11. Air passes through the second moisture absorptive member 12 filled with fluid 130 in the direction as shown by an arrow "b" and the air is humidified. With continuous supply of the liquid 130 and continuous passage of the air flow, the humidification function is continuously in operation. When receiving a sign of "shut down" of the humidification function sent from outside, the driving member 14 controls the second moisture absorptive member 12 to allow it to rotate along the direction as shown by the arrow "d" and finally become isolated from the first moisture absorptive member 11.

In presently preferred implementations, the first moisture absorptive member 11 and the second moisture absorptive member 12 are presented as cuboids or cylinders.

In presently preferred implementations, the liquid 130 is water.

FIG. 1 and FIG. 2 exemplarily show shapes of the first moisture absorptive member 11, the second moisture absorptive member 12, the container 13, and the driving member 14, and relative positions among various elements. Those of skill in the art can understand that in order to realize similar technical effects, the shapes and relative positions of various elements can be appropriately adjusted. For example, the first moisture absorptive member 11 can be completely dipped in the liquid 130 and perpendicular to the still water surface of the liquid 130. As another example, the first moisture absorptive member 11 need not be perpendicular to the still water surface of the liquid 130. As yet another example, the contact surface when the first moisture absorptive member 11 contacts the second moisture absorptive member 12 may be or may be not parallel to the still water surface of the liquid 130, and the contact surface may be a plane or alternatively a curved surface. Feasible technical solutions are not enumerated completely here and are nontheless within the scope of the disclosure.

Though not shown in FIG. 1 and FIG. 2, the driving member 14 can include a driving motor 141 and a driving connecting rod 142 that are connected to each other. The driving motor 141 is configured to receive signs for "shut down" and "operate" of the humidification function sent from outside, and controls rotation of the driving connecting rod 142 to drive movement of the second moisture absorptive member 12.

Figure 3A:
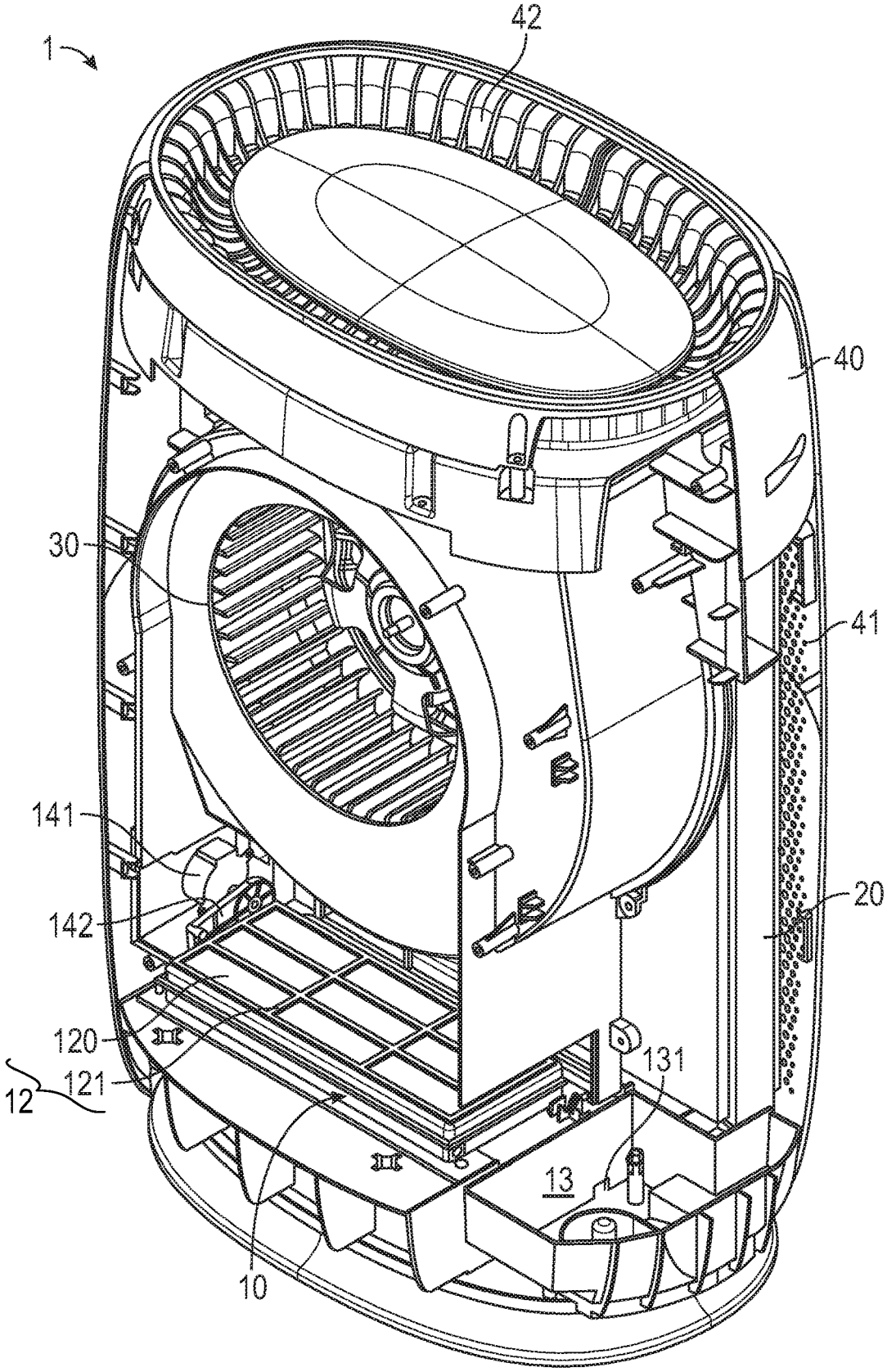
FIG. 3A is an inner structural representation of an air cleaner according to certain particular embodiments of the present disclosure with the humidification function being shut down.
Figure 3B:
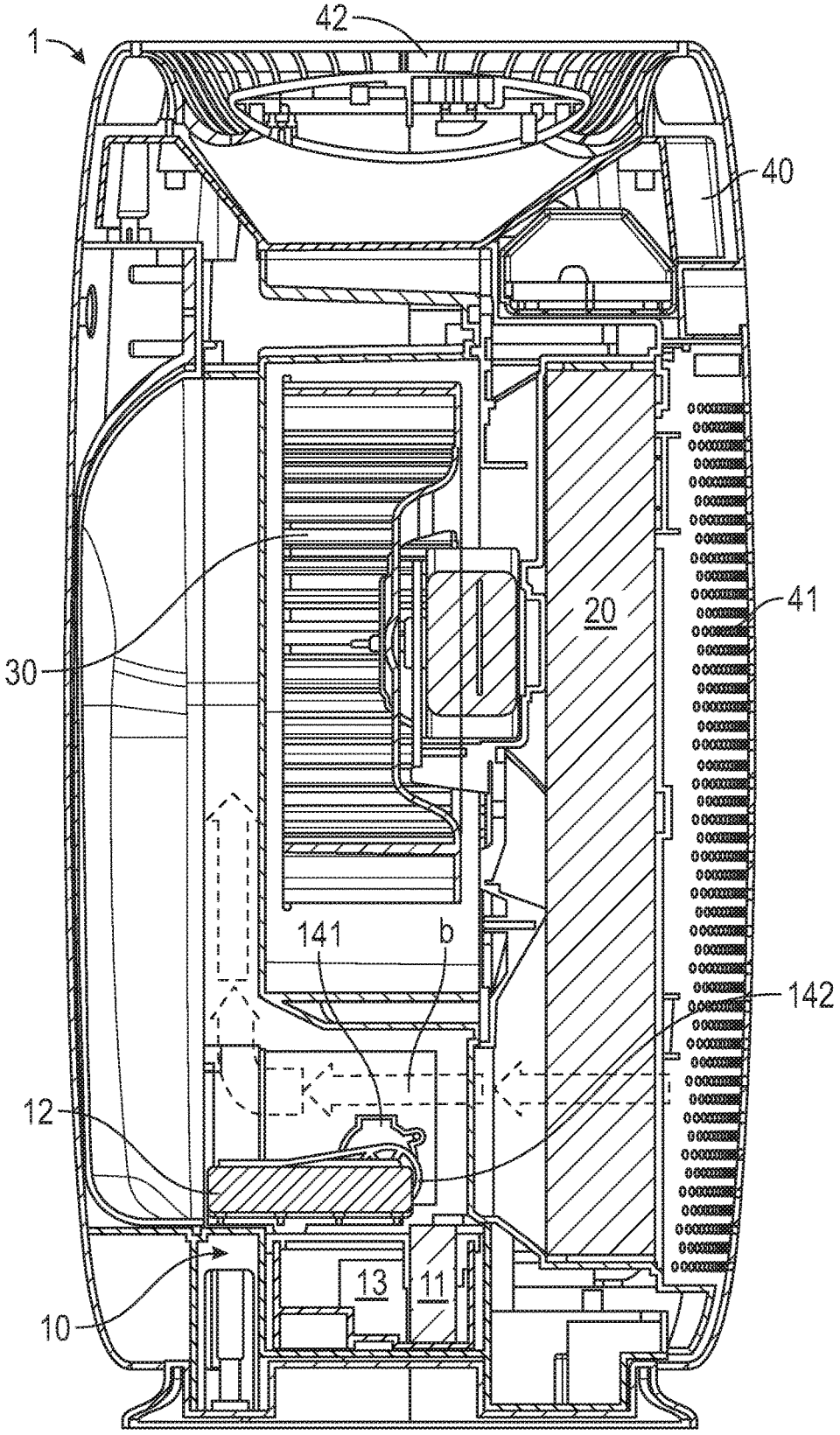
FIG. 3B is a sectional view of an air cleaner according to certain particular embodiments of the present disclosure with the humidification function being shut down.

FIGS. 3A and 3B exemplarily show a structure of an air cleaner 1 with the humidification function being shut down. The air cleaner 1 includes a housing 40, an air strainer 20, a humidifying device 10, and a fan 30. An air-in panel 41 of the housing 40 is provided upstream from the air strainer 20, the humidifying device 10 and the fan 30. An air-out panel 42 of the housing 40 is provided downstream from the air strainer 20, the humidifying device 10 and the fan 30. The air strainer 20 is provided upstream from the humidifying device 10 and the humidifying device 10 is provided upstream the fan 30.

The driving member of the humidifying device 10 includes a driving motor 141 and a driving connecting rod 142. The driving connecting rod 142 is connected to the second moisture absorptive member 12. When receiving a signal from the outside, the driving motor 141 controls the driving connecting rod 142 to allow it to rotate around the fixed end and drive movement of the second moisture absorptive member 12.

At this time, the second moisture absorptive member 12 of the humidifying device 10 is isolated from the first moisture absorptive member 11 (not shown in FIG. 3A). As shown by the arrow in FIG. 3B, air enters through holes provided on the air-in panel 41, passes successively through the air strainer 20 and the humidifying device 10 (at this time, the second moisture absorptive member 12 is away from the gas flow channel), and the air is discharged out of the air-out panel 42 by the rotating fan 30. When the air cleaner 1 has its humidification function shut down, air does not pass through the second moisture absorptive member 12, and thus loss caused by unnecessary air resistance can be avoided.

As shown in FIG. 3A, the second moisture absorptive member 12 includes a moisture absorptive body 120 and a support 121. The moisture absorptive body 120 has good hygroscopicity and air permeability, and wicks or dampening papers can be selected. The support 121 has a certain hardness, and plastic can be selected and allowed to cover the surface of the moisture absorptive body 120 to protect the moisture absorptive body 120 and prevent it from being deformed when it is moved. The figure exemplarily shows the shape and structure of the support 121. It is to be understood that those of skill in the art can envisage other shapes and structure according to teachings in this specification, without departing from the scope and spirit of the present disclosure. Though not shown in the figure, the first moisture absorptive member 11 may also include a moisture absorptive body 120 and a support 121.

Figure 4A:
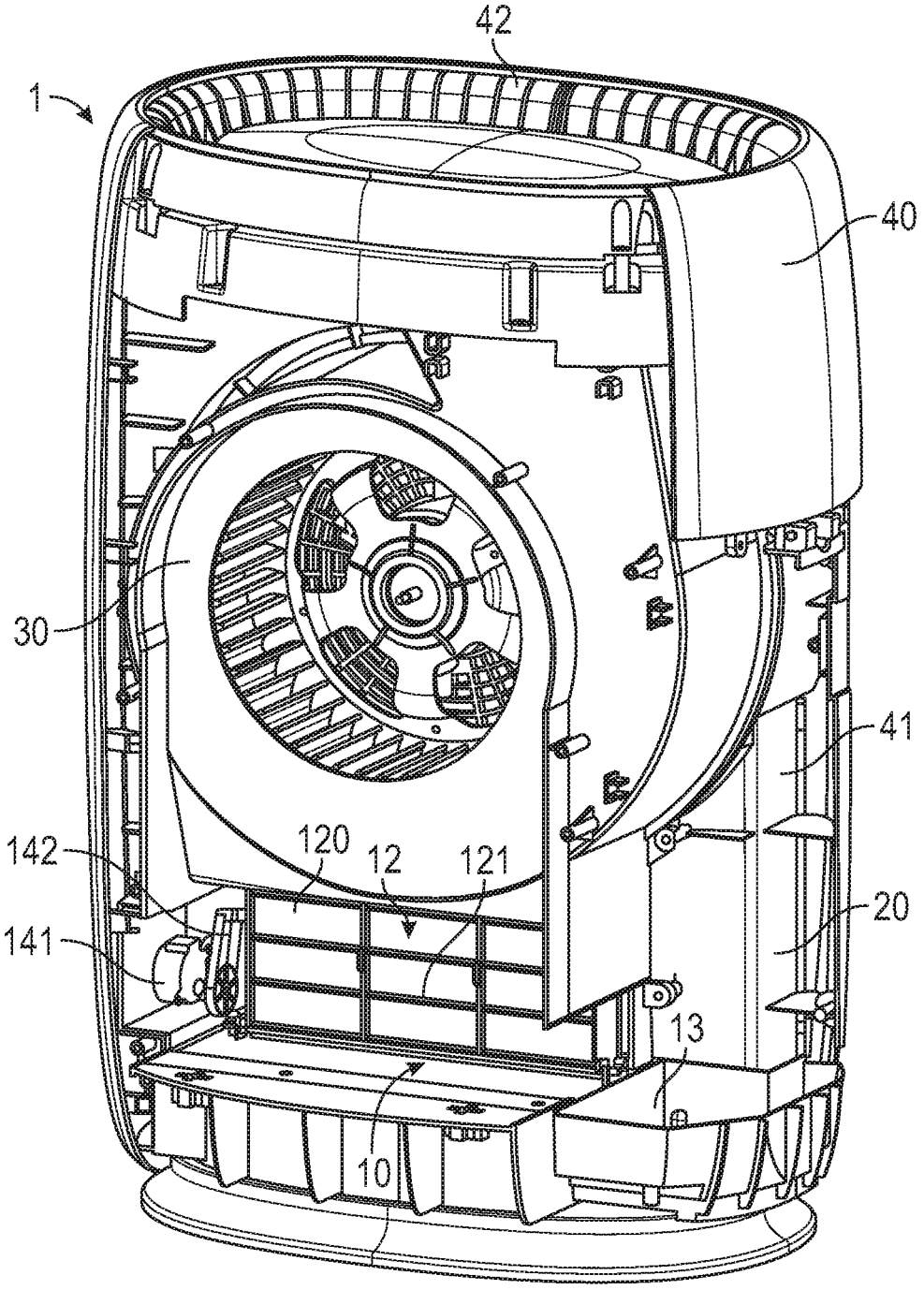
FIG. 4A is an inner structural representation of an air cleaner according to certain particular embodiments of the present disclosure with the humidification function being in operation.
Figure 4B:
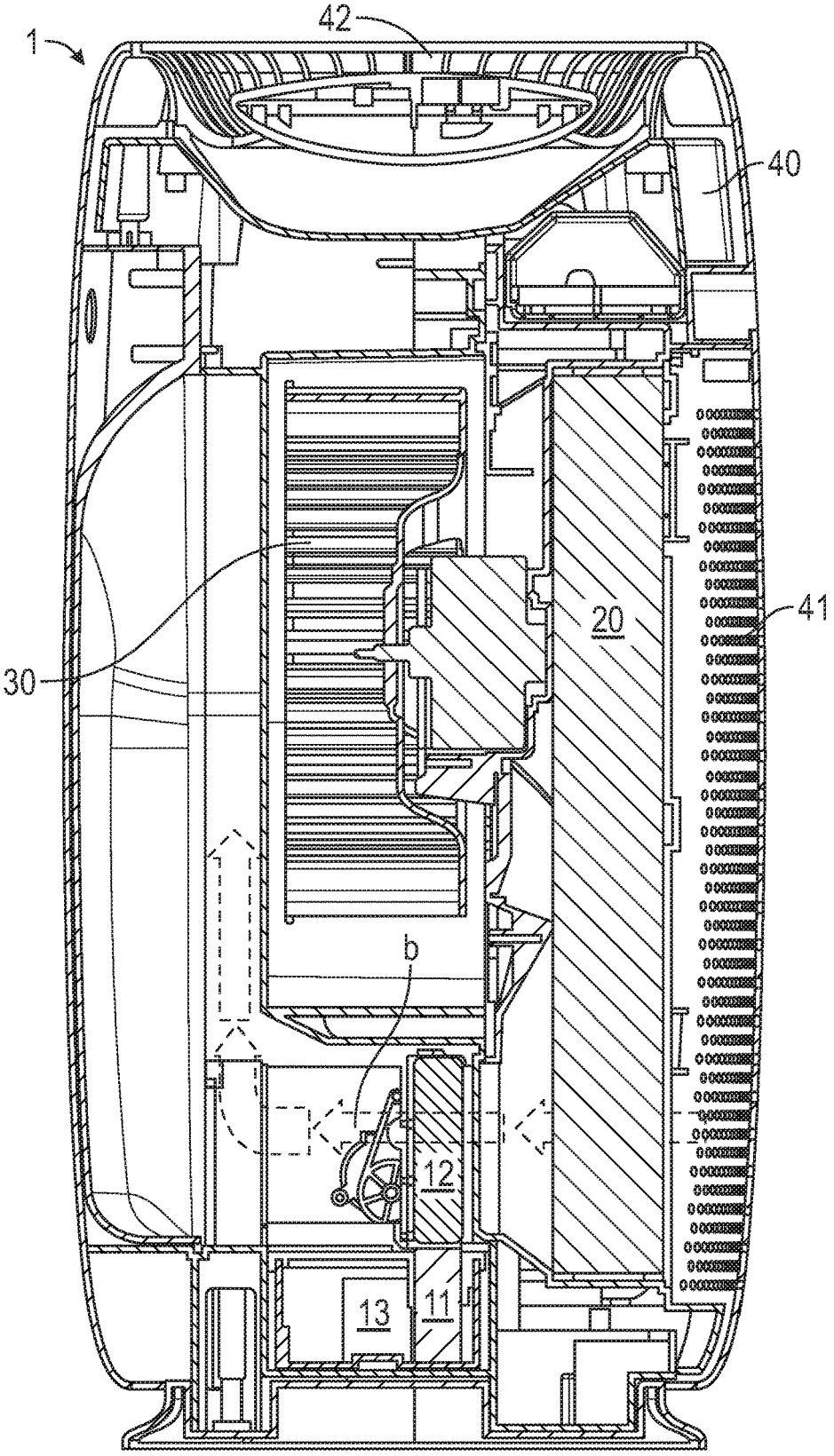
FIG. 4B is a sectional view of an air cleaner according to certain particular embodiments of the present disclosure with the humidification function being in operation.

FIGS. 4A and 4B exemplarily show the structure of the air cleaner 1 with the humidification function being in operation. At this time, under the action of the driving motor 141 and the driving connecting rod 142, the second moisture absorptive member 12 of the humidifying device 10 is located in a position allowing it to contact the first moisture absorptive member 11 (not shown in FIG. 4A). As shown by the arrow in FIG. 4B, air enters through holes provided on the air-in panel 41, and after passing through the air strainer 20, the air then passes through the second moisture absorptive member 12 with liquid (e.g., water) absorbed thereon. The air becomes humidified after passing through the second moisture absorptive member 12. Finally, the rotating fan 30 discharges the humid air out of the air-out panel 42. When the humidification function is in operation, the air cleaner 1 can realize both purification and humidification of air at the same time.

Figure 5:
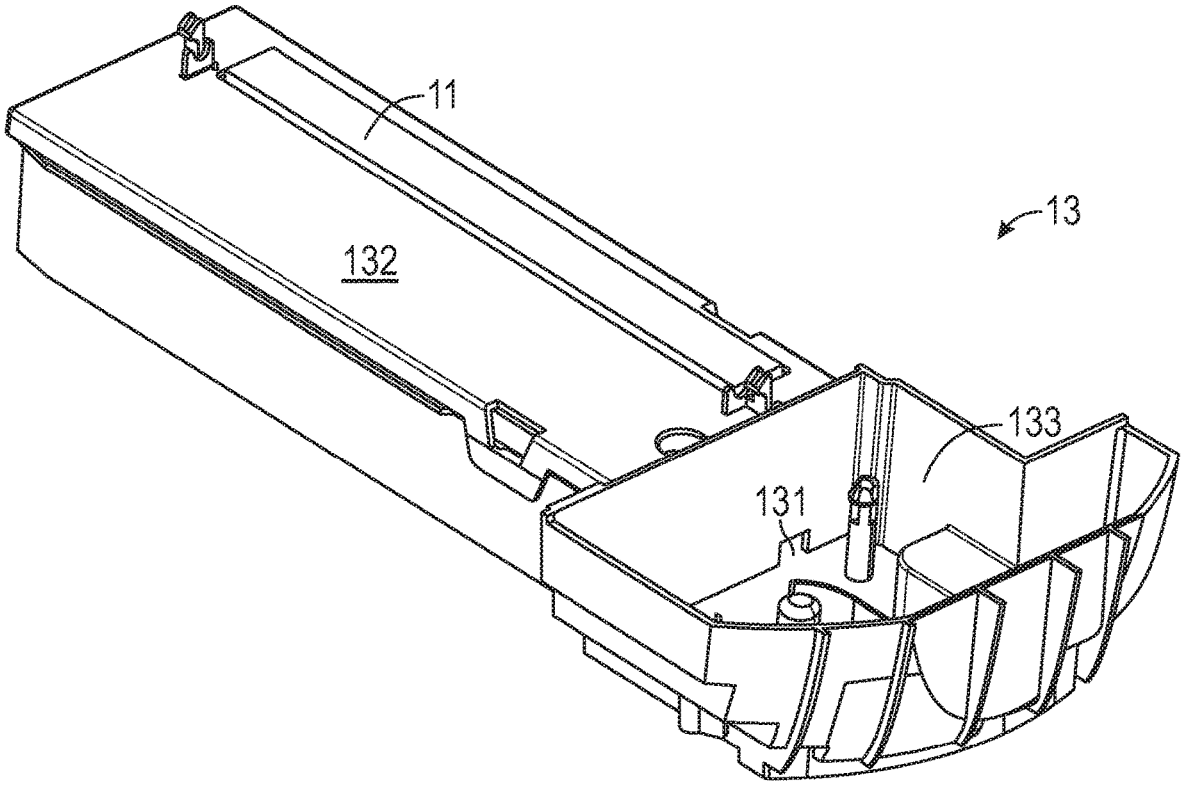
FIG. 5 is a structural representation of a container of a humidifying device according to certain particular embodiments of the present disclosure.

As shown in FIG. 5, the container 13 includes a water injection tank 133, a drainage hole 131 and a closed chamber 132. A solution is injected from the water injection tank 133 into the container 13, and flowed into the closed chamber 132 through the drainage hole 131. The first moisture absorptive member 11 is placed in the closed chamber 132 (not shown), and the closed chamber 132 has a through-hole on the top thereof that allows the first moisture absorptive member 11 to communicatively connect to the outside.

Only the upper surface of the first moisture absorptive member 11 can communicatively connect to outside, and the remainders are all placed in the closed chamber 132, to ensure that air passing through the first moisture absorptive member 11 only flows within the closed chamber 132 where the first moisture absorptive member 11 is located, so as to prevent air leakage from the closed chamber 132, and prevent air admission from the outside into the closed chamber 132 and thereby influencing the air filtration effect.

Parts that have not been described in detail in the present disclosure, for example the air strainer, the fan, the air-in panel, the air-out panel, the housing, the driving motor and the driving connecting rod, are well-known to those of skill in the art, and will not be described unnecessarily any longer here.

The humidifying device provided according to the present disclosure not only can control operation and shut down of the humidification function, but also avoids formation of unnecessary air resistance when the humidification function is shut down. The air cleaner and the household appliance provided according to the present disclosure are not only simple in structure, effective in cost, and convenient in installation, but are also quiet when in operation.

The above particular examples of the present disclosure only exemplarily state the principle of the present disclosure and efficacy thereof, and are not used to limit the present disclosure. Further, various modifications and alterations of the present invention will become apparent to those skilled in the art without departing from the spirit and scope of the invention. The scope of the present application should, therefore, be determined only by the following claims and equivalents thereof.

What is claimed is:

1. A humidifying device, comprising:

a container, configured to accommodate a liquid;

a first moisture absorptive member, at least partially dipped in the liquid in the container;

a second moisture absorptive member with air permeability, in contact with or isolated from the first moisture absorptive member; and a driving member, configured to move the second moisture absorptive member both into contact with the first moisture absorptive member and into a position isolated from the first moisture absorptive member.

2. The humidifying device according to claim 1, wherein, when the second moisture absorptive member is brought into contact with the first moisture absorptive member, the second moisture absorptive member has a maximum blocking area, and when the second moisture absorptive member is isolated from the first moisture absorptive member, the second moisture absorptive member has a minimal blocking area.

3. The humidifying device according to claim 2, wherein, the driving member comprises a driving motor and a driving connecting rod connected that are to each other, and the driving connecting rod connects to and drives the movement of the second moisture absorptive member.

4. The humidifying device according to claim 3, wherein, the first moisture absorptive member is perpendicular to a still water surface of the liquid, and the driving connecting rod drives rotation of the second moisture absorptive member around a fixed end of the driving connecting rod, so as to allow the contact surface when the second moisture absorptive member is brought into contact with the first moisture absorptive member, to be parallel to the still water surface.

5. The humidifying device according to claim 1, wherein, the first moisture absorptive member and the second moisture absorptive member are presented as cuboids or cylinders.

6. The humidifying device according to claim 1, wherein, the first moisture absorptive member and the second moisture absorptive member comprise moisture absorptive bodies with a hygroscopic property, and the moisture absorptive bodies are at least one selected from a group consisting of wicks and dampening papers.

7. The humidifying device according to claim 6, wherein, the first moisture absorptive member and the second moisture absorptive member further comprise supports covering surfaces of the moisture absorptive bodies.

8. The humidifying device according to claim 1, wherein, the container comprises:

a water injection tank;

a closed chamber, comprising through-holes on the top thereof, wherein the first moisture absorptive member is placed within the closed chamber and communicatively connected to the outside via the through-holes; and a drainage hole, communicatively connected to the water injection tank and the closed chamber.

9. The humidifying device according to claim 8, wherein, the liquid is water.

10. An air cleaner, comprising the humidifying device according to claim 1.

11. The air cleaner according to claim 10, comprising:

a housing, comprising an air-in panel and an air-out panel;

an air strainer, provided downstream from the air-in panel;

the humidifying device, provided downstream from the air-in panel;

a fan, provided downstream from the air-in panel; and the air-out panel, provided downstream from the air strainer, the humidifying device and the fan.

12. A household appliance, comprising the humidifying device according to claim 1.

* * * * *